US005638645A

United States Patent [19]

Lipton

[11] Patent Number: 5,638,645

[45] Date of Patent: Jun. 17, 1997

[54] SKYHATCH

[76] Inventor: Mark D. Lipton, 59 Ada Pl., Staten Island, N.Y. 10301

[21] Appl. No.: 570,419

[22] Filed: Dec. 11, 1995

[51] Int. Cl.[6] ..... E04B 7/16; E05F 1/10

[52] U.S. Cl. ..... 52/72; 52/200; 52/66; 49/386; 454/339

[58] Field of Search ..... 52/72, 200, 66, 52/69; 49/386, 379; 454/339

[56] References Cited

U.S. PATENT DOCUMENTS

| | | | |
|---|---|---|---|
| 3,017,721 | 1/1962 | Wasserman . | |
| 3,047,983 | 8/1962 | Wasserman . | |
| 3,182,581 | 5/1965 | Von Poederoyen et al. | 52/72 |
| 3,277,619 | 10/1966 | Miller et al. | 52/72 |
| 3,399,500 | 9/1968 | Shapiro . | |
| 4,208,840 | 6/1980 | Jentoft et al. . | |
| 4,517,765 | 5/1985 | Mucha | 49/379 X |
| 4,845,905 | 7/1989 | Frank . | |
| 4,899,420 | 2/1990 | Bye et al. . | |
| 5,207,036 | 5/1993 | Sampson et al. | 52/72 |

FOREIGN PATENT DOCUMENTS

| | | | |
|---|---|---|---|
| 2510240 | 1/1983 | France | 454/339 |
| 2661703 | 11/1991 | France | 52/66 |
| 738449 | 8/1943 | Germany | 52/66 |

*Primary Examiner*—Wynn E. Wood
*Assistant Examiner*—Timothy B. Kang
*Attorney, Agent, or Firm*—Wigman, Cohen, Leitner & Myers, P.C.

[57] ABSTRACT

A skyhatch or skylight having a case to which one or more wings are pivotably attached whose opening and closing is accomplished by using a combination cable system and pneumatic spring opening and closing mechanism such that the wings can be opened to any desired position between their fully closed and fully opened position on a continuously variable basis.

22 Claims, 4 Drawing Sheets

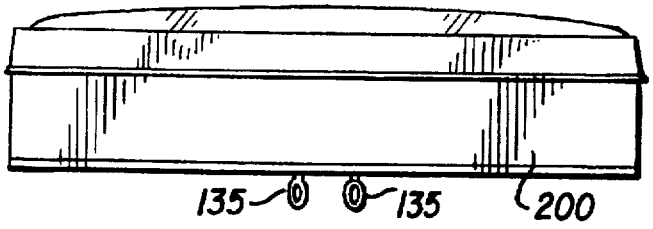
FIG. 8
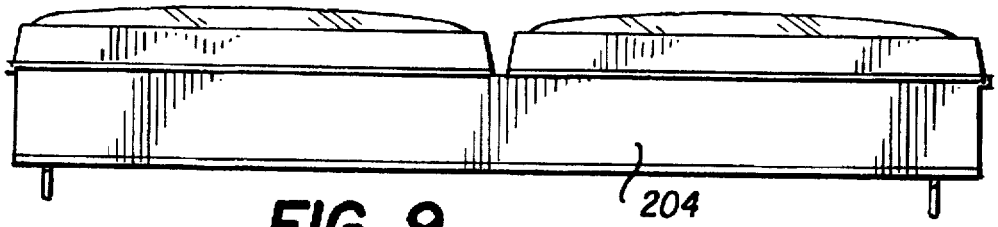
FIG. 9
FIG. 10
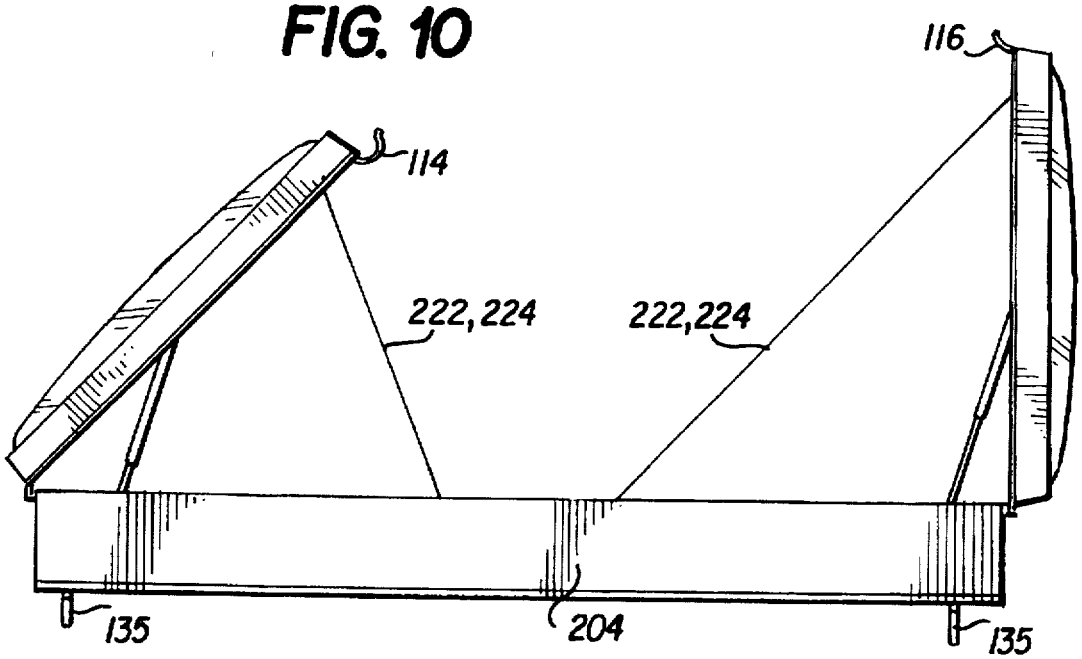

SKYHATCH

BACKGROUND OF THE INVENTION

The present invention relates generally to a skyhatch or skylight having at least one openable wing and at least one pneumatic spring for opening that pivotable wing. More particularly, the present invention relates to a skylight in which the pneumatic spring is pivotably attached near one end of the top of a case and at the other end to the wing of the skylight and which includes an integral closing mechanism which may be operated by a winch using a cable.

In prior art skylights, whether they are used as emergency exits or are merely used for opening up a room to the outdoors, one or more pneumatic springs have been provided which exhibit strokes allowing for relatively long extension of the piston rod out of the cylinder. The pneumatic springs are connected at one end to a wing which opens and to the case at the end. Typically, for example, in an emergency opening position of skylights which are used as emergency exits, the angle between the opened wing and the surface plane of the case of the skylight is 90° or larger. The wings are generally pivotable about a hinge at the rear of the case.

Most skylights, and especially those which may be opened to an angle of at least 90°, do not include an easily used or convenient mechanism for closing the wing after the wing has been opened, for example, to its maximum opened position. While heretofore, poles with hooks at one end have been provided for closing skylight wings by manually placing the hook in a corresponding ring on the skylight wing and pulling or pushing the wing closed, there have not heretofore been any easily operated mechanisms for closing skylight wings that open to an angle of at least 90° between the opened wing and the surface plane of the case. Presumably, since most skylights or vents which open to that degree or angle are used for safety purposes, there has been no need to provide for closing such emergency exits or vents. That is the opposite of the purpose for which such emergency use skylights have been designed.

Traditionally, skylights as used in residential construction or residential ceilings or attic spaces have a width or size opening for the wing which is restricted. Even with skylights which raise the wing partially over the case when opened to their fully opened position, such skylights only allow in a restricted amount of the outdoors and thus, do not duplicate the effect sought by their user, that is, of a roof opening which is opened to the outdoors. Most skylights which provide roof access as an emergency exit or for other purposes, provide an opening to the outdoors when the wing is fully opened. However, no convenient mechanism is provided for closing the wings when they are in that or any other position. In addition, it is desirable to provide a convenient mechanism for adjustment for opening wings to smaller angles in the event that the user does not desire them to be in their fully opened position.

SUMMARY AND OBJECTS OF THE INVENTION

In view of the foregoing, it should be apparent that there is still a need in the art for a skyhatch or skylight which can be used as a skylight in an attic, ceiling or roof in residences, can be opened such that the wings are in an unobtrusive position and which can also be used as an emergency exit. It is, therefore, a primary object of this invention to provide a skylight for use in a commercial building and/or a residential attic, ceiling or roof in which the wings can be opened in such a manner that an unobtrusive view from the skylight to the outdoors is obtained through the case.

More particularly, it is an object of this invention to provide a skyhatch apparatus in which the wings can be conveniently and readily placed in any one of a plurality of continuously variable angle openings as desired by the user and with little opening and dosing effort on the user's part.

Still more particularly, it is an object of this invention to provide a skyhatch having wings which can be moved to their fully opened position, thus easily transforming the skyhatch of the present invention to an emergency opening.

Another object of the present invention is to provide for a reliable and relatively inexpensive skyhatch which is economical to manufacture, easy to install, simple to operate and yet provides the user with full control over the degree of opening of the wings.

A further object of the present invention is to provide a skyhatch which includes one or more wings which are opened using pneumatic springs and which also includes an integral closing mechanism which is used to counteract the force of the pneumatic springs and which is used both to control the degree of opening of the one or more wings as well as to provide a convenient mechanism for closing the one or more wings.

Briefly described, these and other objects of the invention are accomplished by providing a case having a rectangular shape to which one or more moveable wings are hingeally attached at the outer longitudinal edges of the case. In the preferred embodiment, two wings are utilized with the skyhatch or skylight of the present invention. Each of the wings is connected to one end of at least one pneumatic spring whose other end is connected to the inside of the case. A wire rope or cable is also connected to each of the ends of each wing on the opening side of each wing. The cables are each connected through a series of pulleys, to a separate winch.

In order to open the skylight of the present invention, each winch is either manually or through the means of a motor, operated such that, by allowing the wire rope or cable to lengthen, the force or bias of the pneumatic springs causes the wings to pivot about their hinges to the continuously variable opening position desired by the user. The fully opened position of the wings is determined by the length of the fully extended rods of the pneumatic springs or by the adjustment of the cables, or by both.

The construction of the skyhatch or skylight of the present invention is such that it can be used to fully open the case to the outdoors such that the user experiences as much of the outdoors as possible in a room in a building. Alternatively, the present invention can be used in the same manner as a conventional skylight, that is, to allow ventilation and some exposure of the room to the outdoors. The present invention can also be utilized, in the fully opened or almost fully opened position of the wings, as an emergency opening.

BRIEF DESCRIPTION OF THE DRAWINGS

FIG. 8 is a drawing of a side view of the skyhatch of FIG. 1;

FIG. 9 is a drawing of a front view of the skyhatch of FIG. 1; and

FIG. 10 is a drawing of a front view of the skyhatch of FIG. 1 in which one wing is in a partially open position and other wing is in a fully opened position.

DETAILED DESCRIPTION OF THE PREFERRED EMBODIMENT

Figure 1:
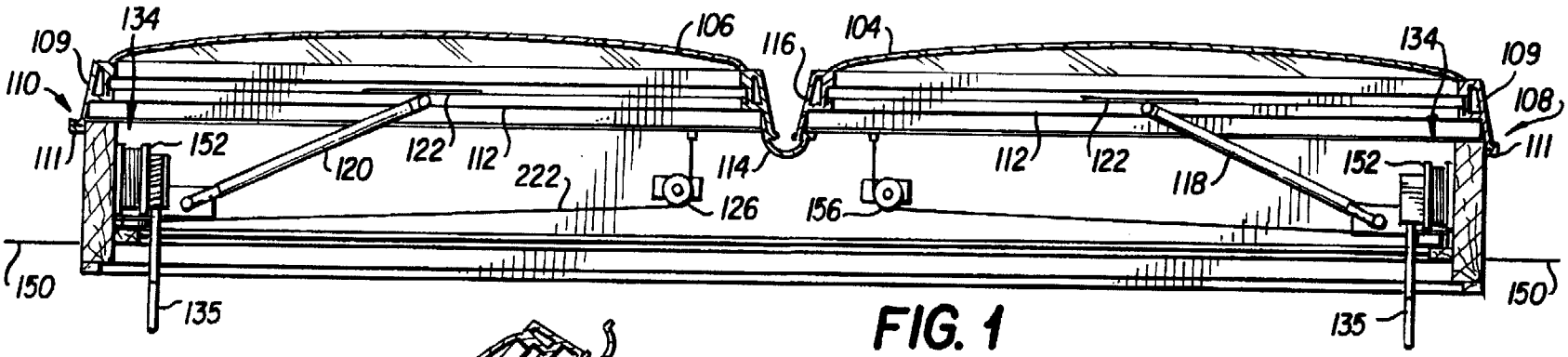
FIG. 1 is a drawing of a front perspective view of the skyhatch of the present invention in which the wings are in their fully closed position.
Figure 3:
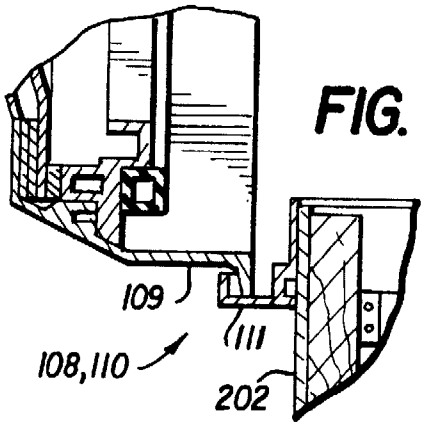
FIG. 3 is a drawing of the hinge details which secure each wing to the longitudinal sides of the case of the skyhatch of FIG. 1.
Figure 2:
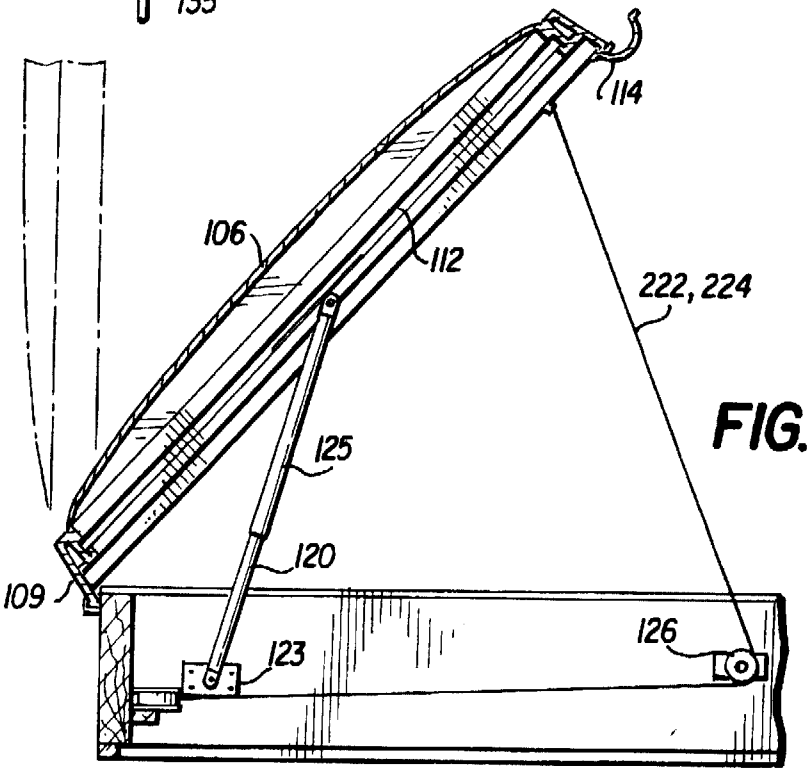
FIG. 2 is a drawing of a partial front perspective view of the skyhatch of FIG. 1 in which one wing is shown in its partially opened position.
Figure 4:
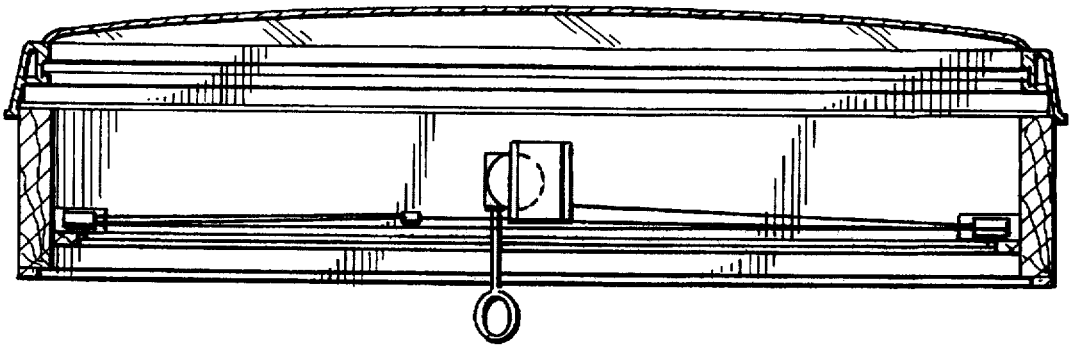
FIG. 4 is a drawing of a side view of the skyhatch of FIG. 1.
Figure 5:
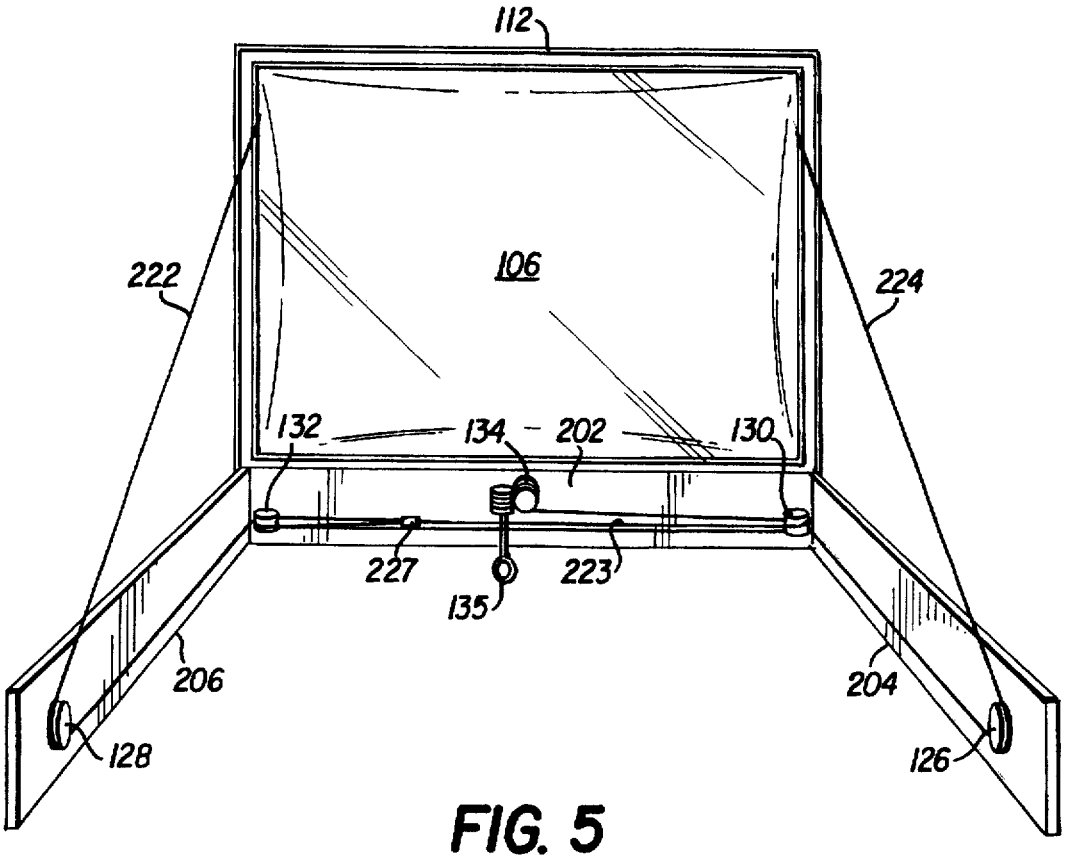
FIG. 5 is a drawing of an inside side perspective view showing the connection of the cables between a wing and the winch of the skyhatch of the present invention.
Figure 6:
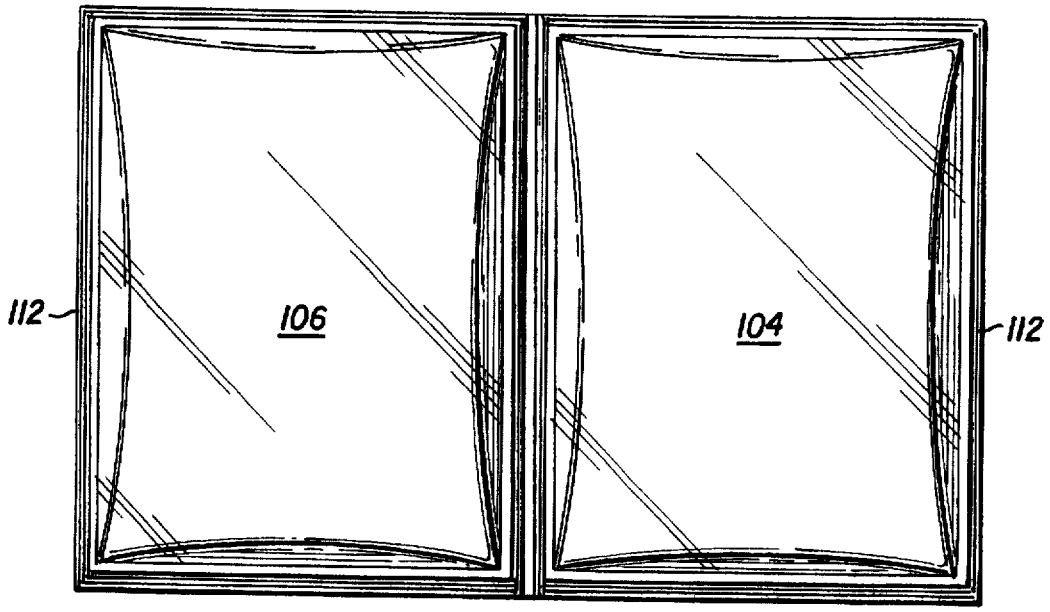
FIG. 6 is a drawing of a top view of the skyhatch of FIG. 1.
Figure 7:
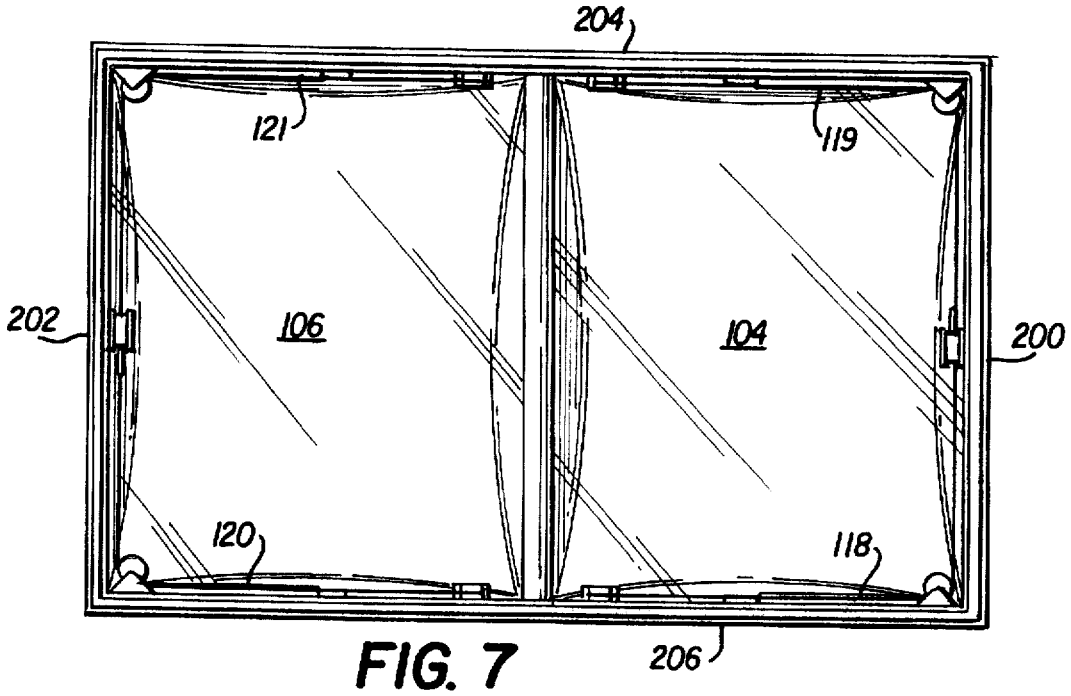
FIG. 7 is a drawing of a bottom view of the skyhatch of FIG. 1.

Referring now in detail to the drawings wherein like parts are designated by like reference numerals throughout, there is illustrated in FIGS. 1–10 the skyhatch or skylight 100 of the present invention. The skyhatch 100 is constructed with a rectangular case 102 to which all of the major components to be described are mounted or attached. It should be understood however, that the case 102 can be constructed in other shapes, such as a square. The case 102 may preferably be constructed from one inch furniture grade birch plywood, or any other suitable material.

Each of the wings 104 and 106 is pivotably attached to the longitudinal sides 200 and 202 of the case 102 by means of the pivoting hinges 108 and 110, respectively. Alternatively, if desired, each of the wings 104 and 106 can be mounted using other types of hinges either to the longitudinal portions 200 and 202 of the case 102 or using the front and back sections 204 and 206 of the case 102. In the preferred embodiment as shown, for example, in FIGS. 1 and 2, the wings 104 and 106 are pivotably attached to the longitudinal sides 200 and 202 of the case 102.

The hinges 108 and 110 are preferably formed as extruded aluminum C channel components 109 and 111 such that, when the wings 104 and 106 are in their closed position, the upper portions of each of the C channels 109 and 111 engage each other, forming a secure and weather-tight seal. Each of the wings 104 and 106 is further constructed from a frame 112 likewise formed from extruded aluminum, including a sealing gasket, all in a known manner. The clear portions of each of the wings 104 and 106 may be formed from clear "DuPont LUCITE" acrylic in a dome shape.

In order to form a weather-proof seal and to provide for drainage, a curved extrusion piece 114 may be affixed to one of the wings 104 and 106 and a corresponding second drainage extrusion 116 affixed to the end of the upper portion of the frame 112 on the other of the two wings 104 and 106. Therefore, as shown in, for example, FIG. 1, when the two wings are in their closed position, a moisture proof seal is formed between the wings 104 and 106 by those two extrusions 114 and 116. Any moisture which contacts the interface between the two wings 104 and 106 is conducted down the drainage extrusion 114 and off of the skyhatch 100 and onto the roof 150 in which the skyhatch 100 is installed. The drainage extrusion 114 may preferably be capped with a PVC coating.

In order to provide a mechanism for opening each of the wings 104 and 106, a pair of pneumatic springs or gas shocks 118, 119 and 120, 121 is provided, respectively, for each of the wings 104 and 106. Alternatively, coil springs or any suitable type of springs may be used. Inasmuch as each of the pneumatic springs or gas shocks 118–121 are identical, only a single one will be described. The pneumatic spring or gas shock 118 is mounted by means of, for example, an aluminum plate 123, to the inside of the front portion 204 or the inside of the back portion 206 of the case 202. The lift arm or rod 125 of each of the pneumatic springs 118–121 is mounted by means of an aluminum bar 122 bolted to the approximate midpoint of the sides of the extruded aluminum frame 112 of each of the wings 104 and 106.

In order to open and close the skyhatch 100 of the present invention against the bias or force of the pneumatic springs or gas shocks 118–121, a cable and pulley system is provided for each of the wings 104 and 106. However, only a single cable and pulley system could also be used. Each cable system is formed from three cables 222–224, as shown in detail in FIG. 5. Each of the cables 222, 224 is mounted to the extruded aluminum frame of each wing 104, 106, near the corner of the side of the frame 112 opposite the hinges 109 and 110. Although wire rope is the preferred cable material for the cables 222–224, other cable or rope materials may also prove satisfactory and may be utilized.

The first cable 224 passes around a first single open side mount pulley 126 mounted to the inside of the front portion 204 of the case 102 in a vertical position. The cable 224 then passes over a double open upright mount pulley 130 which is mounted to the inside of the longitudinal piece 202 of the case 102 to which the wing 106 is hingedly attached. From there, the first cable 224 passes around one half of a second double open upright mount pulley 132 to a point where it is spliced as described hereafter to the second cable 222 and the winch cable 223.

The second cable 222, which is attached near a corner of the opposite side of the frame 112 of the top wing 104 as the first cable 224, passes over and around a second single open side mount pulley 128 mounted to the case 102 opposite to the first single open side mount pulley 126. It then passes around the other half of the second double open upright mount pulley 132 which is attached to one longitudinal side 202 of the case 102. It then is attached at the splice 227 to the first cable 224 and to the winch cable 223. The winch cable 223 passes over half of the double open upright mount pulley 130 and from there is attached to the drum 152 of the winch 134 which may be either manually operated or motor driven. A ring handle 135 is provided which may be engaged by a pin on a pole in a known manner to effect manual operation of the winch 134.

In operation, when the skyhatch 100 is in an opened position, that is, when the wings 104 and 106 open, the winch 134 is turned in the counterclockwise direction so that each of the cables 222 and 224 become shorter. As the winch cable 223 is wrapped around the winch drum 152, each of the cables 222 and 224 become shorter, and they pull each of the wings 104 and 106 against the force of the pneumatic springs or gas shocks 118–121, until each wing is in a fully closed position. In order to open the skyhatch 100 of the present invention to any particular angle of the wings 104 and 106 with respect to the case 102, the process is reversed. That is, the winch 134 is turned in the clockwise position for the desired amount, thus causing the pressure of the pneumatic springs or gas shocks 118–121 to open the wings 104 and 106 to an angle corresponding to the length of the cables 222 and 224. Thus, it will be obvious to those of ordinary skill in the art that the combination of the cable and pneumatic springs systems disclosed herein allows the user to open the wings 104 and 106 to any desired angle between 0–90 degrees, on a continuous and fully variable basis.

The skyhatch 100 of the present invention is designed such that the wing 104 should be open before the other wing 106, due to the arrangement of the drainage extrusions 114 and 116. Thus, two separate cable and winch systems are provided. Therefore, when opening the skyhatch 100 of the present invention, the winch 134 which controls the movement of the wing 104 should be rotated slightly to move the wing 104 to a position which allows the drainage extrusion 116 to be cleared by the drainage extrusion 114 of the wing 106 as that wing 106 is opened. Then, either winch 134 can be operated at will to move either or both of the wings 104 and 106 to the desired positions. Obviously, the drainage extrusions 114 and 116 have a similar, although generally opposite, effect on the closing process.

The case 102 and thus the skyhatch 100 of the present invention is mounted through a roof 150 in a manner as is known to those of ordinary skill in the art. Due to the design of the skyhatch 100 disclosed herein, it can be used to allow a totally unobscured view of the sky as well as an unobscured opening from the outdoors into a building. In its fully opened and nearly fully opened positions, it can be used as an escape opening, if desired. It can also be utilized during certain religious festivals, such as the Jewish holiday of Succos to simulate an outside succah. That is, the traditional succah structure can be simulated by covering the case 102 with the traditional coverings such as bamboo, cornstalks etc . . . which are used on succah structures built on the ground.

Although only a preferred embodiment is specifically illustrated and described herein, it will be appreciated that many modifications and variations of the present invention are possible in light of the above teachings and within the purview of the appended claims without departing from the spirit and intended scope of the invention.

What is claimed is:

1. A skyhatch comprising:

a case having a front and a back and two longitudinal sides;

at least one wing pivotally attached to one of said two longitudinal sides of said case;

a spring mechanism connected between said at least one wing and said case for biasing said at least one wing into an open position; and a cable system comprising a winding mechanism connected between said at least one wing and said case for opening and closing said at least one wing against the biasing of said spring mechanism to a desired position between and including fully closed and fully open.

2. The skyhatch of claim 1, wherein said cable system operates to adjust said open position of said at least one wing to any desired position between 0 and 90 degrees with respect to said case.

3. The skyhatch of claim 1, wherein said at least one wing is pivotably attached to one of said two longitudinal sides of said case by a two piece C channel hinge.

4. The skyhatch of claim 1, wherein two wings are pivotably attached to said case, one to each of said two longitudinal sides of said case.

5. The skyhatch of claim 4, wherein each of said two wings can be pivoted independently of the other.

6. The skyhatch of claim 4, further including a second spring mechanism and second cable system connected between the second wing and said case for opening and closing said second wing.

7. A skyhatch having two movable wings, comprising:

a case having a front and a back and two longitudinal sides;

a first and a second wing, each wing being pivotably attached to one of said two longitudinal sides of said case;

first and second spring systems connected between each of said first and second wings and said case for biasing said first and second wings into an open position; and first and second cable systems connected respectively between each of said first wing and said case and said second wing to desired positions between and including fully closed and fully open and said case for opening and closing said first and second wings against the biasing of said first and second spring systems.

8. The skyhatch of claim 7, wherein each of said first and second cable systems operate to adjust said open position of their respective first and second wings to a desired position between 0 and 90 degrees with respect to said case.

9. The skyhatch of claim 7, wherein each of said first and second wings is pivotably attached to one of said respective two longitudinal sides of said case by a two piece C channel hinge.

10. The skyhatch of claim 7, wherein each of said first and second cable systems comprises a winding mechanism mounted to said case.

11. The skyhatch of claim 10, wherein each of said first and second cable systems further comprises first and second cables each attached to said respective first and second wings and being connected to a winding cable such that the winding of said respective winding mechanism causes said first and second wings to pivot about their respective longitudinal side of said case against the biasing of their respective first and second spring systems.

12. The skyhatch of claim 10, wherein said winding mechanism is one of manually and motor operated.

13. The skyhatch of claim 7, wherein each of said first and second spring systems is comprised of at least one gas shock.

14. The skyhatch of claim 7, wherein each of said first and second spring systems is comprised of two spring mechanisms, each connected between said case and said respective one of said first and second wings.

15. A method of operating a skyhatch having a case having a front and a back and two longitudinal sides and at least one wing pivotally attached to one of said two longitudinal sides of said case, comprising the steps of:

providing a spring mechanism between said at least one wing and said case for biasing said at least one wing in an open position;

providing a cable system comprising a winding mechanism also connected between said at least one wing and said case for opening and closing said at least one wing against the biasing of said spring mechanism; and operating said cable system such that said at least one wing is moved by said biasing provided by said spring mechanism to a desired position between and including fully closed and fully open.

16. The method of operating a skyhatch of claim 15, wherein said spring mechanism is comprised of at least one gas shock.

17. The method of operating a skyhatch of claim 15, wherein said spring mechanism is attached to said at least one wing at a point about midway on at least one side of said at least one wing.

18. The method of operating a skyhatch of claim 15, wherein said cable system is attached to said at least one wing at a point near a corner opposite a side of said at least one wing which is pivotably attached to said case.

19. The method of operating a skyhatch of claim 15, wherein said winding mechanism is operated by one of manually and a motor.

20. The method of operating a skyhatch of claim 15, wherein two wings are pivotally attached to said case and a second cable system comprising a winding mechanism is provided, the method further including the step of operating each of said two wings using the two said cable systems, to open and close independently of each other.

21. A method of operating a skyhatch having a case having a front and a back and two longitudinal sides and two wings, each pivotally attached to one of said two longitudinal sides of said case, comprising the steps of:

providing a spring mechanism between each of said respective wings and said case for biasing each of said two wings in an open position;

providing first and second cable systems, each comprising a winding mechanism, each connected respectively between one wing and said case for opening and closing each of said respective wings against the biasing of a respective spring mechanism; and operating at least one of said respective cable systems such that said at least one of said two wings is moved by said biasing provided by said respective spring mechanism to any desired position between and including fully.

22. The method of operating a skyhatch of claim 21, further including the step of operating said first and second cable systems to independently open and close each of said two wings.

* * * * *

UNITED STATES PATENT AND TRADEMARK OFFICE

CERTIFICATE OF CORRECTION

PATENT NO. : 5,638,645

DATED : June 17, 1997

INVENTOR(S) : Lipton

It is certified that error appears in the above-indentified patent and that said Letters Patent is hereby corrected as shown below:

Claim 21, Column 8, line 10, "any" should read --a--;

Column 8, line 11, after "fully" add --closed and fully open--.

Signed and Sealed this

Ninth Day of September, 1997

*Attest:*

Bruce Lehman

BRUCE LEHMAN

*Attesting Officer*

*Commissioner of Patents and Trademarks*